US007241948B2

(12) United States Patent
Cummings

(10) Patent No.: US 7,241,948 B2
(45) Date of Patent: Jul. 10, 2007

(54) STRINGED MUSICAL INSTRUMENT DEVICE

(75) Inventor: Patrick G. Cummings, Putnam Valley, NY (US)

(73) Assignee: iGuitar, Inc., Poughkeepsie, NY (US)

( * ) Notice: Subject to any disclaimer, the term of this patent is extended or adjusted under 35 U.S.C. 154(b) by 108 days.

(21) Appl. No.: 11/072,545

(22) Filed: Mar. 3, 2005

(65) Prior Publication Data

US 2006/0196348 A1 Sep. 7, 2006

(51) Int. Cl.
*G10H 3/18* (2006.01)

(52) U.S. Cl. ..... 84/731; 84/723

(58) Field of Classification Search ..... None
See application file for complete search history.

(56) References Cited

U.S. PATENT DOCUMENTS 6,191,350 B1 * 2/2001 Okulov et al. ..... 84/646
2003/0159570 A1 8/2003 Toshitani
2004/0144241 A1 7/2004 Juskiewicz et al.
2004/0187673 A1 * 9/2004 Stevenson ..... 84/737
2005/0235813 A1 * 10/2005 Barry ..... 84/723
2006/0101987 A1 * 5/2006 Celi et al. ..... 84/723

* cited by examiner

*Primary Examiner*—Marlon Fletcher
(74) *Attorney, Agent, or Firm*—McCormick, Paulding & Huber LLP

(57) ABSTRACT

A stringed musical instrument device that functions as a peripheral for a computer or computing device, whereby electronic transducers placed inside and/or outside the instrument convert the vibrations of the strings and/or the instrument body from an analog electrical signals to digital signals. The digital signals are then transmitted via Class Compliant USB and/or FireWire-IEEE 1394 and/or IEEE 802.11 wireless and/or Bluetooth® wireless protocols to any computer or computing device that accepts data via those protocols. This device requires no external power, amplification, analog-to-digital conversion, software or hardware. This device is an improvement over the prior art in that it accurately and immediately represents on a computer or computing device the signals that are being sent from the instrument and reduces the number of devices needed to accomplish the task of sending digital signals to a computer or computing device.

17 Claims, 3 Drawing Sheets

STRINGED MUSICAL INSTRUMENT DEVICE

FIELD OF THE INVENTION

This invention relates generally to musical instruments, and more particularly to stringed musical instruments that also serve as a peripheral to a computer or computing device.

BACKGROUND OF THE INVENTION

Stringed musical instruments are commonly amplified by attaching an electronic transducer to the face or top of the instrument so that the transducer lies under the strings or inside the body of such instrument. The electronic transducer picks up the vibrations of the strings and transfers the energy in the form of an analog electrical signal. The electrical signal is then commonly output to a musical instrument amplifier which contains speakers and amplifiers to increase the electronic signal. The amplifier, depending upon its own features, adds various tones and effects via a preamplifier.

With the proliferation of personal computers and computing devices, musicians of all levels are frequently employing software on their computers and computing devices for many purposes including multi-track recording, editing, mastering, adding effects, composing, remixing, film scoring, and creating notation for musical instrument education and publishing exploitation. Furthermore, with the vast resources available on the Internet, musicians are able to use online music forums and online software to enhance, share and publish their musical performances.

While traditional musical instruments are designed to be readily used in a recording or live venue or other concert setting, these instruments are ill-equipped for usage with personal computers. Furthermore, traditional stringed instruments which transmit analog signals have disadvantages because the electric signal is subject to various degrees of output, degradation and distortion.

In order to overcome these obstacles, there have been prior art electrical guitars designed with hexaphonic pickups which send Musical Instrument Digital Information ("MIDI") signals to a computer. These musical instruments allow musicians to connect their instrument to a computer and for the computer to recognize the signals generated. However, MIDI signals are "command" signals, and the resulting sound rendered by the instrument is not always an accurate representation of the original sound generated by the musician's performance as translated to the strings of the musical instrument. In addition, tracking, or the simultaneous response from the musician's performance in triggering a sound through MIDI, often results in a time lag or a lack of accurate tracking.

Furthermore, many MIDI guitars require an external device which converts the electronic signal from the hexaphonic pickup into a MIDI signal. In these systems, the MDI signals generated by the external interface device are then sent from the external interface device to the computer. These systems have disadvantages because they require a relatively sophisticated external device which adds expense and which are frequently difficult to operate and cumbersome for the musician to use. Such external devices add more connections to the system of performance.

In order to send a more faithful representation of the sound from the musical instrument's strings to the personal computer, prior art devices have been developed wherein an interface device converts the analog electrical signal to a digital signal. For example, Patent Application No. 2003/0159570 (the "570 Application") discloses a digital interface for analog musical instruments that can be detachably mounted on the instrument wherein proper placement is crucial for accurate performance or undetachably integrated in the musical instrument body. The interface apparatus involved in the 570 Application converts the analog signal generated by the musical instrument into a digital signal. The interface apparatus then has connections to be able to connect into a personal computer allowing for the transmission of such digital data directly to the personal computer.

While these prior art devices can enable a musical instrument player to send an accurate representation of the initial electrical signal from the instrument pickup device to a personal computer, the disadvantage of these prior art devices is that it is difficult for the computer to recognize the information sent from the musical instrument in order to be able to process such information effectively. The musician requires specific drivers to be installed to allow the computer to recognize the information that is being sent from the musical instrument. Furthermore, the majority of the most popular musical instrument software programs do not recognize these prior art instruments without first running specific programs or "patches" for the prior art instruments.

The installation of software can be time consuming and complicated. Driver software often does not record the signal properly. Moreover, many patches or programs to allow these musical instruments to be properly recognized by a personal computer or a specific software application have not been created. Therefore, a disadvantage to the prior art devices is that a musical instrument player is often limited in the availability of software programs to use in connection with a prior art device.

Another disadvantage of the prior art devices is that it is often expensive to purchase additional software allowing the computer to recognize the guitar signals. Additionally, the installation of these programs can be complicated. Further, even upon successful installation, the user can still experience compatibility problems which can lead to errors within the computer and the software applications.

In addition, Patent Application No. 2004/0144241 (the "241 Application") relies almost entirely on an outboard device that will split the signal from the guitar. This outboard device, often called a "breakout box," only makes more complex the number of wiring connections necessary, while adding cost and the possibility of signal quality loss and/or output volume loss.

Accordingly, it is an object of the present invention to provide a stringed musical instrument device that overcomes the above-mentioned drawbacks and disadvantages.

SUMMARY OF THE INVENTION

The present invention is embodied in a musical instrument device which is designed to overcome the prior issues and thus be accurately connected to a computer or computing device and to be instantly and accurately recognized by the computer or computing device. The musical instrument contains electronic transducers situated under the strings and/or inside the body. The electronic transducers pick up the vibrations from the instrument strings and/or the vibrations from the instrument body in order to produce an analog electrical signal that is accurately representative of such vibrations. The device has an apparatus integrated wholly inside the instrument containing an analog-to-digital converter. This apparatus also contains output protocols that are designed to send the digital information to a computer, computing device or other external device. These "digital out" protocols are configured for protocols widely used in connection with communications between a peripheral and a computer or computing device. These protocols include Universal Serial Bus, FireWire-IEEE 1394, MIDI, 13pin, IEEE 802.11 wireless, and Bluetooth® wireless.

In a first aspect of the present invention, a stringed musical instrument device functioning as a peripheral for a computer or computing device comprises a body having a soundboard and a neck extending from the body. At least one string extends over a portion of the body and the neck. A piezo bridge is mounted on the body for providing a lower contact point with the string. At least one electronic transducer is coupled to the body for converting vibrations of the string and/or the body into analog electrical signals. At least one analog-to-digital converter communicates with the electronic transducer for converting the analog electrical signals into digital signals. A digital signal processing system communicates with the analog-to-digital converter for converting the digital signals into line level signals such as, for example, universal serial bus (USB) signals having a format directly compatible with protocols associated with input ports of a computer or computing device.

In a second aspect of the present invention, an electric guitar comprises a body having a soundboard and a neck extending from the body. At least one string extends over a portion of the body and the neck. A piezo bridge is mounted on the body for providing a lower contact point with the string. At least one piezo pickup is associated with the piezo bridge for converting vibrations of the string and/or the body into analog electrical signals. At least one magnetic pickup is coupled to the body for converting vibrations of the string and/or the body into analog electrical signals. At least one analog-to-digital converter communicates with the piezo pickup and the magnetic pickup for converting the analog electrical signals into digital signals. A digital signal processing system communicates with the analog-to-digital converter for converting the digital signals into line level signals such as, for example, USB signals having a format directly compatible with protocols associated with input ports of a computer or computing device.

In a third aspect of the present invention, an acoustic guitar comprises a body having a soundboard and a neck extending from the body. At least one string extends over a portion of the body and the neck. A piezo bridge is mounted on the body for providing a lower contact point with the string. At least one piezo pickup is associated with the piezo bridge for converting vibrations of the string and/or the body into analog electrical signals. At least one analog-to-digital converter communicates with the piezo pickup for converting the analog electrical signals into digital signals. A digital signal processing system communicates with the analog-to-digital converter for converting the digital signals into line level signals such as, for example, USB signals having a format directly compatible with protocols associated with input ports of a computer or computing device.

DETAILED DESCRIPTION OF THE PREFERRED EMBODIMENTS

Figure 1:
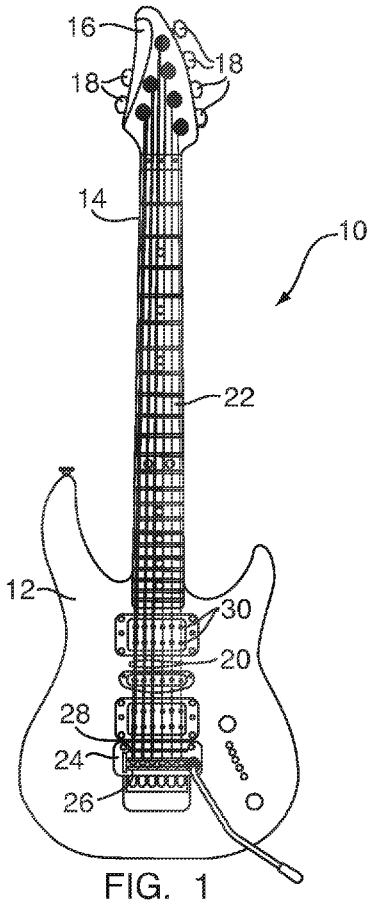
FIG. 1 is a top plan view of an electric guitar embodying the present invention.

With reference to FIG. 1., an electric guitar embodying the present invention is indicated generally by the reference number 10. Although the present invention will be described with respect to a guitar, it should be understood that the present invention is applicable to other stringed instruments including, but not limited to, violins, violas, basses and mandolins.

The electric guitar 10 comprises a body 12 connected to a neck 14. The neck 14 is preferably made of wood or a related material which is suitable to withstand continual string pull without warping or twisting. The neck 14 has a headstock 16 which supports tuning machines 18. The tuning machines 18 hold strings 20. The strings 20 are strung at tension and extend from a fixed point at the neck 14 to a lower string contact. The neck 14 is mated with a fretboard 22 which is preferably made of a hard substance such as rosewood, ebony, or a reinforced polymer that should be strong enough and stable enough to hold metal frets and withstand playing wear. The body 12 is preferably made of a known tonewood, such as spruce, cedar, alder, mahogany, koa, basswood, or other acoustically resonant materials such as wood laminates, organic composite plastic and/or metals or any combination of the same.

The guitar 10 further comprises a bridge assembly 24, including an electronic transducer 26 that transfers the vibration of the strings 20 to a bridge or piezo bridge 28, attached to the body 12 and made from metal, plastic or a hardwood such as ebony, rosewood, or a suitably hard acoustically sound material. The bridge or piezo bridge 28 provides a contact point to fixably secure the strings 20.

The body 12 includes a plurality of magnetic pickups 30 at a base of the neck 14, and in the middle of the body 12, all of which generate analog electrical signals from vibration of the strings 20 and/or the body 12. The analog electrical signals are transferred to an internal digital signal processing system such as, for example, the system to be explained below with reference to FIG. 3. The digital signal processing system has an output to transfer a digital signal to an output port located on the guitar 10 such as a Universal Serial Bus (USB) output port and/or a FireWire output port and/or a 13-pin output port and/or a IEEE 802.11 wireless transmitter and/or a Bluetooth® wireless transmitter. Moreover, the guitar 10 also includes a conventional stereo ¼" phono jack output port. Preferably, the at least one output port is mounted inside the body 12 or the neck 14 and includes external access. As shown in FIG. 4, for example, a guitar 300 embodying the present invention has a body 302 and a class compliant USB output port 304 mounted inside the body 302 and including external access.

Figure 2:
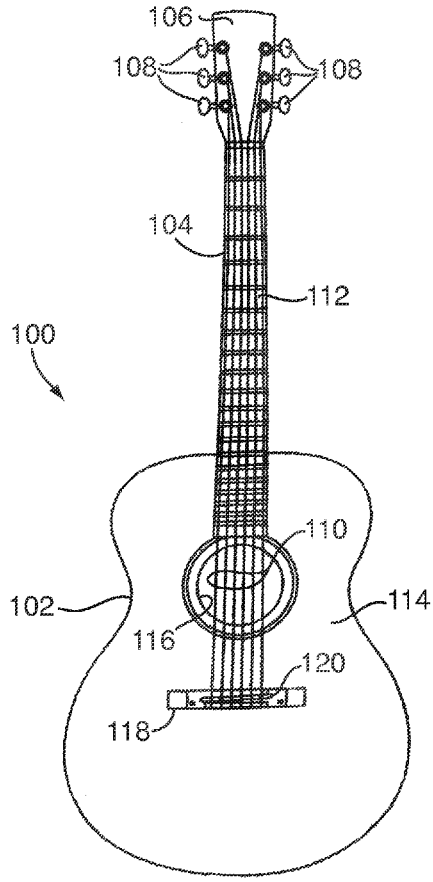
FIG. 2 is a top plan view of an acoustic guitar embodying the present invention.

With reference to FIG. 2., an acoustic guitar embodying the present invention is indicated generally by the reference number 100. The guitar 100 comprises a generally hollow body 102 preferably made of a resonant material. The body 102 is connected to a neck 104. The neck 104 is preferably made of wood or a related material which is suitable to withstand continual string pull without warping or twisting. The neck 104 has a headstock 106 which supports tuning machines 108. The tuning machines 108 hold strings 110. The strings 110 are strung at tension and extend from a fixed point at the neck 104 to a lower string contact. The neck 104 is mated with a fretboard 112 which is preferably made of a hard substance such as rosewood, ash, maple, ebony, a reinforced polymer, or other organic or synthetic material that should be strong enough and stable enough to hold metal frets and withstand playing wear. The guitar 110 further comprises a soundboard 114 preferably made of a known tonewood, such as spruce, cedar, alder, mahogany, koa, basswood, or other acoustically resonant materials such as wood laminates, carbon fiber, organic composites, plastics and/or metals or any combination of the same.

The top, sides and back of the soundboard 114 form a resonant chamber. The soundboard 114 defines a sound hole 116, which can be round, oval, or aesthetically shaped. A bridge 118 is attached to the soundboard 114 and serves as a contact point to fixably secure the strings 110. The bridge 118 is preferably made from a hardwood such as ebony or rosewood, hard plastic, or a suitably hard acoustically sound material. A piezo pickup 120 is inserted into the bridge 118 and generates analog electrical signals from vibration of the strings 110 and/or the body 102. The analog electrical signals are transferred to a digital signal processing system 200 as will be explained with reference to FIG. 3. The digital signal processing system has an output to transfer a digital signal to an output port located on the guitar 100 such as a Universal Serial Bus (USB) output port and/or a FireWire output port and/or a 13-pin output port and/or a IEEE 802.11 wireless transmitter and/or a Bluetooth® wireless transmitter. Moreover, the guitar 110 also includes a conventional stereo ¼" phono jack output port. Preferably, the at least one output port is mounted inside the body 102 or the neck 104 and includes external access.

Figure 3:
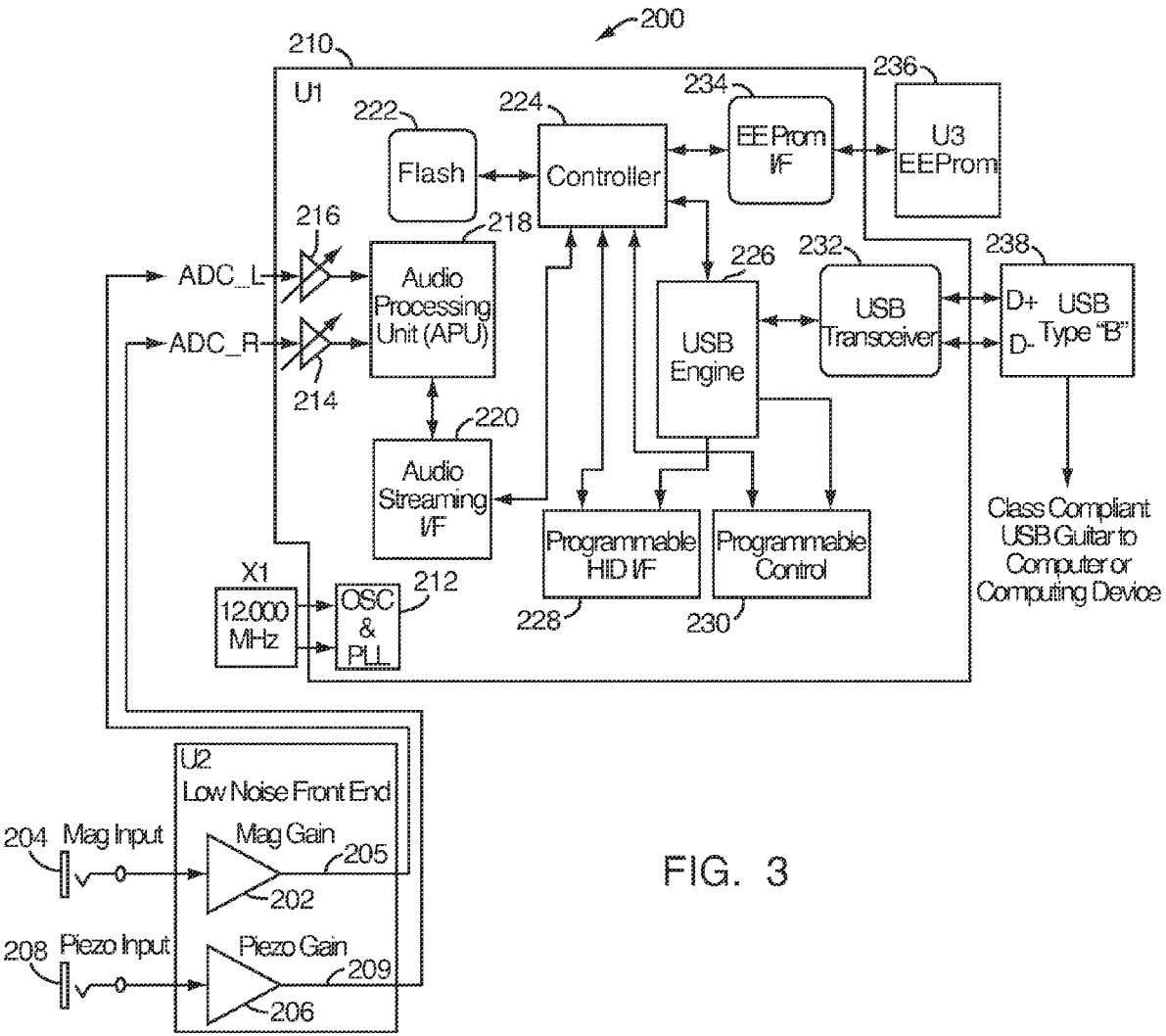
FIG. 3 is a schematic block diagram of an electronic processing section of a guitar in accordance with the present invention.
Figure 4:
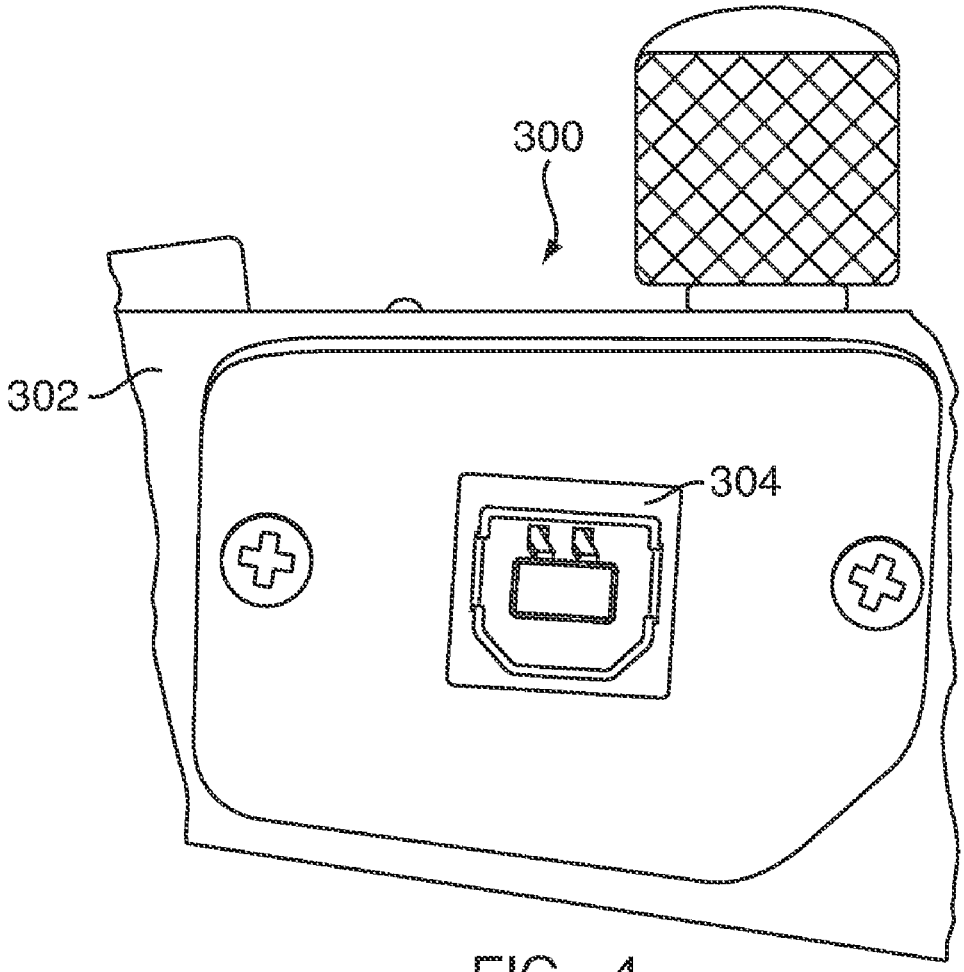
FIG. 4 is a side view of a class compliant USB output port mounted on a guitar in accordance with the present invention.

As shown in FIG. 3, an example of a digital signal processing system for processing stereo signals generated by the strings of guitars, such as the guitars illustrated in FIGS. 1 and 2, is indicated generally by the reference number 200. The system 200 has a first stereo channel including magnetic gain amplifier 202 having a magnetic input 204 for receiving analog electrical signals generated from magnetic pickups, and an output 205 for carrying amplified analog signals for further processing. The system 200 has a second stereo channel including a piezo gain amplifier 206 includes an input 208 for receiving analog electrical signals generated from a piezo pickup, and an output 209 for carrying amplified analog signals for further processing.

The above-mentioned analog electrical signals are further processed via a digital signal processor indicated generally by the reference number 210. The processor 210 includes an oscillator and phase-locked loop (PLL) 212 for receiving a clocked signal, a first analog-to-digital converter 214, a second analog-to-digital converter 216, an audio processing unit 218, an audio streaming interface 220, a flash memory 222, a controller 224, a USB engine 226, a programmable human interface 228 reserved for future growth, a programmable control 230 reserved for future growth, a USB transceiver 232, an EEPROM interface 234, an EEPROM 236 and a USB output connector 238. Examples of digital signal processors include, but are not limited to, the Micronas UAC 3556 Universal Serial Bus Codec, the AKM AK5371 Two Channel A/D Converter with USB Interface, the AKM AK 4571 USB Interface Audio Codec, and the Analog Devices ADSP-2184 DSP Microcontroller.

The first analog-to-digital converter 214 has an input coupled to the output 209 of the piezo gain amplifier 206, and the second analog-to-digital converter 216 has an input coupled to the output 205 of the magnetic gain amplifier 202. An output of the first analog-to-digital converter 214 is coupled to a first input of the audio processing unit 218. Likewise, an output of the second analog-to-digital converter 216 is coupled to a second input of the audio processing unit 218. The audio processing unit 218 is bidirectionally coupled to the audio streaming interface 220. Moreover, the audio streaming interface 220 is bidirectionally coupled to the controller 224. The controller 224 is itself bidirectionally coupled to the flash memory 222, the programmable human interface 228, the programmable control 230, the USB engine 226, and the EEPROM interface 234. The USB Engine 226 has a first output coupled to the programmable human interface 228, a second output coupled to the programmable control 230, and is also bidirectionally coupled to the USB transceiver 232. The EEPROM interface 234 is bidirectionally coupled to the EEPROM 236. The USB transceiver 232 is bidirectionally coupled to the USB output connector 238.

In operation, audio electrical analog electrical signals originating from playing a guitar or other stringed instrument are generated from piezo pickups and/or magnetic pickups. The audio analog electrical signals are amplified by the magnetic gain amplifier 202 and the piezo gain amplifier 206. The amplified analog signals are converted into digital signals by the first and the second analog-to-digital converters 214, 216. The digital signals are received and processed by the audio processing unit 218 in conjunction with the audio streaming interface 220. The digital signal processing system 200 is configured to process sampling rates such as, but not limited to, at least 48 kHz for 16 bit digital information and at least 96 kHz for 24 bit digital information. The controller 224, receiving instructions from the programmable human interface 228 and the programmable control 230, receives streaming digital signals from the audio streaming interface 220 and directs the digital signals to the USB engine 226. The USB engine 226 converts the received signals into USB digital signals for serial transmission under USB protocols. The USB signals are sent from the USB engine 226 to the USB transceiver 232 for transmission via a USB output connector 238 to another device such as a computer or other computing device (not shown) in class compliant USB signal format, and includes streaming audio and MIDI data for recording or other digital processing or manipulation via conventional music digital signal processing software such as, for example, GarageBand™ by Apple Computer, Inc.

In sum, the present invention requires no external power, amplification, analog-to-digital conversion, software or hardware. The present invention is an improvement over the prior art in that it accurately and immediately represents on a computer or computing device the signal that is being sent from an instrument and reduces the number of devices needed to accomplish the task of sending a digital signal to a computer or computing device.

As will be recognized by those of ordinary skill in the pertinent art, numerous modifications and substitutions can be made to the above-described embodiment of the present invention without departing from the scope of the invention. Accordingly, the preceding portion of this specification is to be taken in an illustrative, as opposed to a limiting sense.

What is claimed is:

1. A stringed musical instrument device that also functions as a peripheral for a computer or comparing device, comprising:

a body having a soundboard;

a neck extending from the body;

at least one string extending over a portion of the body and the neck;

a piezo bridge mounted on the body for providing a lower contact point with the string;

at least one electronic transducer coupled to the body and configured for converting at least one of vibrations of the at least one string and the body into analog electrical signals;

at least one analog-to-digital converter communicating with the at least one electronic transducer and configured for converting the analog electrical signals into digital signals;

a digital signal processing system communicating with the at least one analog-to-digital converter and configured for converting the digital signals into line level signals having a USB signal format for coupling, via a USB connector, to USB input ports of a computer or computing device, the digital signal processing system including an engine configured for converting audio signals into class compliant USB signal format including streaming audio and MIDI data; and wherein said at least one analog-to-digital converter and digital signal processing system are configured to be powered by said computer or computing device via said USB connector.

2. A stringed musical instrument device as defined in claim 1, further comprising an output port communicating with the digital signal processing system.

3. A stringed musical instrument device as defined in claim 1, wherein the at least one electronic transducer includes at least one piezo pickup.

4. A stringed musical instrument device as defined in claim 1, wherein the at least one elecironic transducer includes at least one magnetic pickup.

5. A stringed musical instrument device as defined in claim 1 wherein the at least one electronic transducer includes at least one piezo pickup and at least one magnetic pickup.

6. A stringed musical instrument device as defined in claim 1, wherein the digital signal processing system includes an engine configured for converting digital signals into a FireWire signal format.

7. A stringed musical instrument device as defined in claim 1, wherein the digital signal processing system includes an engine configured for converting digital signals into a 13-pin signal format.

8. A stringed musical instrument device as defined in claim 1, wherein the digital signal processing system includes an engine configured for converting digital signals into an IEEE 802.11 wireless signal format.

9. A stringed musical instrument device as defined in claim 1, wherein the digital signal processing system includes an engine configured for converting digital signals into a Bluetooth® wireless signal format.

10. A stringed musical instrument device as defined in claim 1, wherein at least one of the body and the neck defines at least one output port communicating with the digital signal processing system and configured for enabling the line level signals to be conveyed to a computer or computing device.

11. A stringed musical instrument device as defined in claim 10, wherein the at least one output port includes a stereo ¼" phono jack output port and a class compliant USB output port.

12. A stringed musical instrument device as defined in claim 1, wherein the digital signal processing system is configured to process at a sampling rate of at least 48 kHz for 16 bit digital information.

13. A stringed musical instrument device as defined in claim 1, wherein the digital signal processing system is configured to process at a sampling rate of at least 96 kHz for 24 bit digital information.

14. An electric guitar comprising:

a body having a soundboard;

a neck extending from the body;

at least one string extending over a portion of the body and the neck;

a piezo bridge mounted on the body for providing a lower contact point with the string;

at least one piezo pickup associated with the piezo bridge and configured for converting at least one of vibrations of the at least one string and the body into analog electrical signals;

at least one magnetic pickup coupled to the body and configured for converting at least one of vibrations of the at least one string and the body into analog electrical signals;

at least one analog-to-digital converter communicating with the at least one piezo pickup and the at least one magnetic pickup, and configured for converting the analog electrical signals into digital signals; and a digital signal processing system communicating with the at least one analog-to-digital converter and configured for converting the digital signals into line level signals having a class compliant USB signal format including streaming audio and MDI data for coupling, via a USB connector, to an input port of a computer or computing device.

15. An acoustic guitar comprising:

a body having a soundboard;

a neck extending from the body;

at least one string extending over a portion of the body and the neck;

a piezo bridge mounted on the body for providing a lower contact point with the string;

at least one piezo pickup associated with the piezo bridge and configured for converting at least one of vibrations of the at least one string and the body into analog electrical signals;

at least one analog-to-digital converter communicating with the at least one piezo pickup and configured for converting the analog electrical signals into digital signals; and a digital signal processing system communicating with the at least one analog-to-digital converter and configured for converting the digital signals into line level signals having a class compliant USB signal format including streaming audio and MIDI data for coupling, via a USB connector, to an input port of a computer or computing device.

16. A stringed musical instrument device that also functions as a peripheral for a computer or computing device, comprising:

a body having a soundboard;

a neck extending from the body;

at least one string extending over a portion of the body and the neck;

a bridge mounted on the body for providing a lower contact point with the string;

at least one electronic transducer coupled to the body and configured for converting at least one of vibrations of the at least one string and the body into analog electric signals;

at least one analog-to-digital converter communicating with the at least one electronic transducer and configured for converting the analog electric signals into digital signals; and a digital signal processing system communicating with the at least one analog-to-digital converter and configured for converting the digital signals into line level signals having a class compliant USB signal format including streaming audio and MIDI data for coupling, via a USB connector, to an input port of a computer or computing device.

17. A stringed musical instrument device that also functions as a peripheral for a computer or computing device, comprising:

a body having a soundboard;

a neck extending from the body;

at least one string extending over a portion of the body and the neck;

a bridge mounted on the body for providing a lower contact point with the string;

at least one electronic transducer coupled to the body and configured for converting at least one of vibrations of the at least one string and the body into analog electric signals;

at least one analog-to-digital converter communicating with the at least one electronic transducer and configured for converting the analog electric signals into digital signals; and a digital signal processing system communicating with the at least one analog-to-digital converter and configured for converting the digital signals into line level signals having a class compliant wireless USB signal format including streaming audio and MIDI data for communicating with an input port of a computer or computing device.

* * * * *

UNITED STATES PATENT AND TRADEMARK OFFICE

CERTIFICATE OF CORRECTION

PATENT NO. : 7,241,948 B2
APPLICATION NO. : 11/072545
DATED : July 10, 2007
INVENTOR(S) : Patrick G. Cummings It is certified that error appears in the above-identified patent and that said Letters Patent is hereby corrected as shown below:

Column 6, Claim 1, Line 2, please delete the word "comparing" and replace it with the word --computing--.
Column 7, Claim 14, Line 2, please delete the word "elecironic" and replace it with the word --electronic--.
Column 8, Claim 14, Line 24, please delete the letters "MDI" and replace it with the letters --MIDI--.

Signed and Sealed this

Eighteenth Day of March, 2008

JON W. DUDAS
*Director of the United States Patent and Trademark Office*